United States Patent [19]

Nagano et al.

[11] Patent Number: 4,719,693

[45] Date of Patent: Jan. 19, 1988

[54] RESISTANCE ELEMENT FOR WOUND-TYPE VARIABLE RESISTORS AND METHOD OF MAKING SAME

[75] Inventors: Kentaro Nagano, Yokohama; Taichiro Kotani, Hatano, both of Japan

[73] Assignee: Tokyo Cosmos Electric Co., Ltd., Japan

[21] Appl. No.: 805,433

[22] Filed: Dec. 5, 1985

[30] Foreign Application Priority Data

May 10, 1985 [JP] Japan ..... 60-97956

[51] Int. Cl.[4] ..... H01C 17/04

[52] U.S. Cl. ..... 29/618; 156/630; 338/302

[58] Field of Search ..... 29/610 R, 618; 134/14; 338/302, 303; 156/630, 656, 664

[56] References Cited

U.S. PATENT DOCUMENTS

| | | | |
|---|---|---|---|
| 2,019,457 | 10/1935 | Lodge | 338/302 |
| 3,227,986 | 1/1966 | Serdahely et al. | 29/618 |
| 3,282,821 | 11/1966 | Cistola | 29/610 R |
| 4,053,977 | 10/1977 | Simon et al. | 29/610 R |
| 4,406,994 | 9/1983 | Brech et al. | 338/302 |

*Primary Examiner*—P. W. Echols

*Attorney, Agent, or Firm*—McGlew and Tuttle

[57] ABSTRACT

A resistance element causing less sliding noise for use in wound-type variable resistors and a method of making the same are disclosed. A resistance element obtained by winding a metallic resistance wire on a core is subjected to etching treatment. With this etching treatment, the metallic oxides, chlorides and sulfides considered acting as insulators, and organic molecules, adsorbed gases and other contamination forming the surface layer of the resistance wire are dissolved and removed. Furthermore, by immersing the etched resistance element in an ammonia solution, etc., the copper precipitated on the surface of the resistance wire is dissolved.

3 Claims, 19 Drawing Figures

RESISTANCE ELEMENT FOR WOUND-TYPE VARIABLE RESISTORS AND METHOD OF MAKING SAME

BACKGROUND OF THE INVENTION

This invention relates to a resistance element for wound-type variable resistors and the method of making the same.

In general, the wound-type variable resistor uses as the resistance element a metallic resistance wire wound on a core, over which a slider is moved to obtain a desired resistance value. One of the disadvantages of such wound-type variable resistors is that sliding noise is caused as the slider slides over the resistance element while making contact with the element. "Sliding noise" is electrical noise, i.e., contact noise between the slider and the resistance element when the slider is moved relative to the resistance element. Contact Resistance Variation, CRV which is the maximum, instantaneous change in contact noise is a very common specification for an evaluation of electrical noise characteristic in wound-type variable resistors. Therefore, the work "sliding noise" is used to mean Contact Resistance Variation hereinafter. Some of the wound-type variable resistors of the conventional type generate sliding noise immediately after being assembled. Other types of variable resistors produce sliding noise after a lapse of time or after exposure to elevated temperatures. In such variable resistors, sliding noise may be temporarily suppressed by reciprocating the slider over the resistance element several times, but the once-suppressed noise tends to be generated again after a lapse of time or after exposure to high-temperature atmosphere. Such sliding noise is attributable to the uneven contact resistance between the slider and the resistance element resulting from the formation of a film on the surface of the resistance wire by metallic oxides, chlorides and sulfides, together with various organic molecules, adsorbed gases and other contamination, which act as insulators on the surface of the resistance element. Particularly, the formation of a surface film by metallic oxides, chlorides and sulfides is attributable partly to oxidation by the outside atmosphere, or to the formation of intermetallic compounds by the ingredients (for example, iron sulfides, iron chlorides, etc.) of lubricant used in the die-drawing of metallic resistance wires.

As methods for preventing the sliding noise resulting from the formation of a film on the surface of the resistance wire, technologies disclosed in the Japanese Utility Model Publication No. 27447 of 1963 and the Japanese Utility Model Publication No. 33081 of 1979 have been proposed. The former is concerned with the method in which a hard-to-oxidize electrically conductive layer is formed by applying a silver-plating film or silver paste to the portion at which the resistance wire makes contact with the slider to prevent the oxidation of that portion. The latter, on the other hand, involves the method in which a resistance wire coated with an electrically conductive resin film is wound on a core to prevent the oxidation of the portion at which the resistance wire makes contact with the slider. Because of the increased cost of the resistance wire involved, both methods are considered impracticable, except for use in special-purpose variable resistors. Furthermore, these conventional technologies are concerned solely with prevention of the oxidation of the resistance wire by the outside atmosphere, and not with preventing the sliding resistance which is increased by the formation of alloys on the resistance wire surface by the ingredients of lubricant during the die-drawing of the resistance wire.

In the specification of the U.S. Pat. No. 3,697,920, a technology of depositing aluminum silicate on the surface of the resistance element to reduce sliding noise between the resistance element and the slider has been disclosed. Although the reason why sliding noise can be reduced by disposing aluminum silicate on the resistance element surface has not been made clear in the U.S. patent specification, it is evident that the patent is not intended to remove a film on the surface of the resistance wire formed by the ingredients of lubricant during the drawing of the resistance element.

There can be another method of reducing sliding noise in wound-type variable resistors by increasing the contact pressure of the slider with the resistance element. In a resistance element (for use in a small-sized wound-type variable resistor having a total resistance value of 20 kohms, for example) in which a resistance wire as fine as, say, approx. 16 microns in diameter is used, it is impossible to increase the contact pressure because of possible breakage of the resistance wire.

SUMMARY OF THE INVENTION

It is an object of the present invention to provide a resistance element having low-noise characteristics for wound-type variable resistors that can overcome the aforementioned drawbacks, and a method of making the same.

The resistance element for wound-type variable resistors according to this invention is characterized in that the metallic resistance wire of the resistance material, wound on a core is subjected to etching treatment.

The method of manufacturing the resistance element of wound-type variable resistors according to this invention is characterized in that a resistance material is formed by winding a metallic wire on a core, and the resistance wire of the resistance material is subjected to etching treatment.

DETAILED DESCRIPTION OF THE INVENTION

This invention is based on the concept that electrolytic or chemical etching of a resistance material obtained by winding a resistance wire on a core could remove a small amount of metal on the surface of the resistance wire, together with contaminants, thus removing the metallic oxides, chlorides and sulfides considered acting as insulators, together with organic molecules, adsorbed gases and other contamination and cleaning the surface of the resistance wire, thereby reducing or eliminating sliding noise.

Although various types of alloy wires are used as resistance wires according to specific applications, nickel-chromium (Ni-Cr) and copper-nickel (Cu-Ni) alloys are most commonly used. Since these Ni-Cr and Cu-Ni alloys are not oxidized at approx. 120° C., resistance wires made of these metals, after being subjected to etching treatment, are not oxidized by the normal outside atmosphere. Consequently, there is no fear that the resistance wire improved by etching treatment will deteriorate again in the normal outside atmosphere.

With a resistance wire made of a Cu-Ni alloy, however, copper may be precipitated on the surface of the resistance wire, depending on etching conditions. When such a resistance wire is held at high temperatures for a long period of time, the precipitated copper is oxidized, acting as an insulator to help produce sliding noise. In such a case, it is necessary to dissolve the precipitated copper.

With a resistance wire made of a Ni-Cr or Cu-Ni alloy, the surface thereof remains glossy so long as a surface film stays thereon. The surface, however, loses gloss, becoming a matted surface, after etching treatment removes the surface film. The formation of the matted surface increases frictional resistance, thus improving contact resistance, between the resistance element and the slider. This contributes further to reduction of sliding noise.

In the following, this invention will be described in detail, referring to the embodiments thereof.

Embodiment 1

This embodiment involves electrolytic etching on a resistance element comprising a resistance wire containing Ni and Cr wound on a core.

Figure 1A:
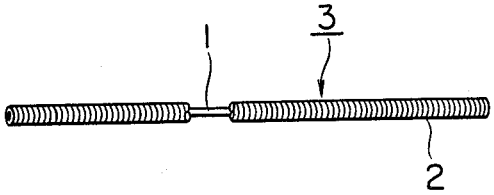
FIG. 1A is a perspective view of a linear resistance material.
Figure 1B:
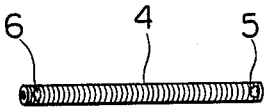
FIG. 1B is a perspective view of a resistance element cut from the linear resistance material shown in FIG. 1A.

As shown in FIG. 1A, a linear resistance material 3 is prepared by winding a commercially available 57-micron-dia. resistance wire 2 containing Ni and Cr (Trade name: Karma wire, manufactured by Driver-Harris Co.) on a 1.4-mm-dia. polyester-coated copper wire 1 at 89-micron pitches. A resistance element 4 is cut from the linear resistance material 3, as shown in FIG. 1B, and both ends 5 and 6 of the resistance element 4 are soldered so as to attain the length of the resistance element 4 at which the resistance value between the soldered ends becomes 500 ohms.

Figure 2:
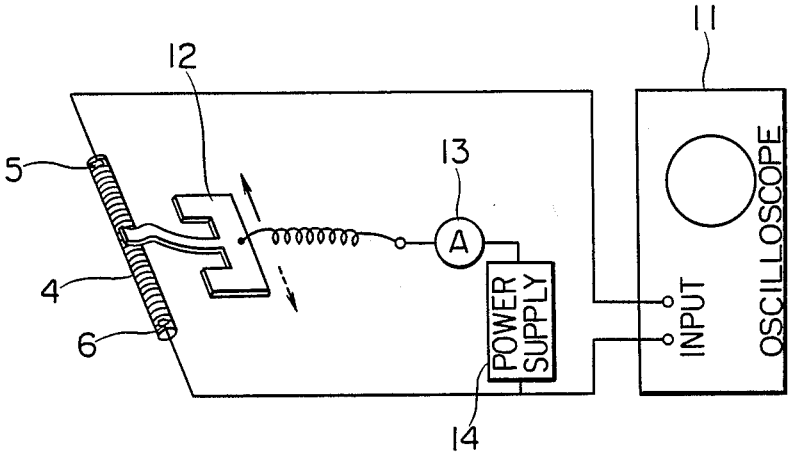
FIG. 2 is a diagram illustrating the setup of a sliding noise measuring device.
Figure 3A:
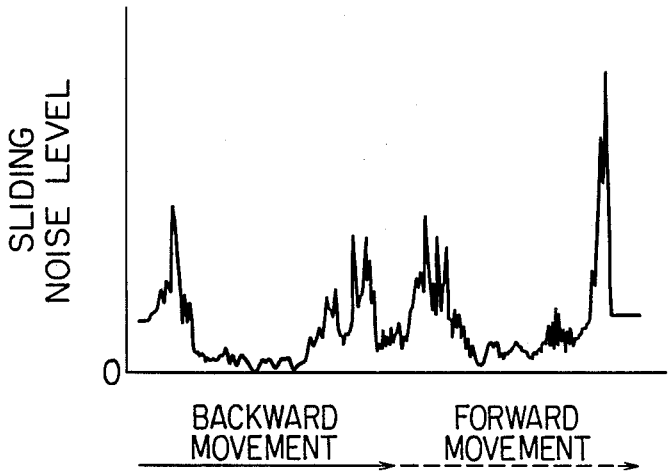
FIG. 3A is a diagram illustrating the sliding noise level of a resistance element which was not subjected to electrolytic etching.

The resistance element 4 thus produced (not subjected to electrolytic etching) was ultrasonically cleaned in an acetone bath to remove soil on the surface of the resistance wire and allowed to dry. Then, the sliding noise of the resistance element 4 was measured with a sliding noise measuring device shown in FIG. 2. The measurement of sliding noise was performed in accordance with the constant-current method specified in MIL Specification (MIL-R-27208A, Measurement of Peak Noise). A slider 12 deposed in contact with the resistance element 4 is connected to a constant-current source 14 via an ammeter 13, the end 5 of the resistance element 4 and the slider 12 are connected to the vertical input terminals of an oscilloscope 11, and the end 6 of the resistance element 4 is connected to the constant-current source 14. A 1-mA constant current was applied across the slider 12 and the end 6 of the resistance element 4 to measure noise over the entire sliding range while causing the slider 12 to slide from the end 5 to the end 6, and then from the end 6 to the end 5, as shown by arrows in the figure, at a rate of 3 mm/sec. FIG. 3A shows the sliding noise level observed on the oscilloscope. In the figure, the ordinate represents the sliding noise level measured, and the abscissa time. The portion shown by an arrow (⟶) represents the section covered by the forward movement of the slider 12, and the portion shown by another arrow (→) the section covered by the backward movement of the slider 12. It was found that the resistance element 4 not subjected to electrolytic etching generates a high level of sliding noise over the entire sliding range. The sliding noise is attributable to a surface film (of metallic oxides, chlorides, sulfides, etc.) formed on the resistance wire.

Figure 4:
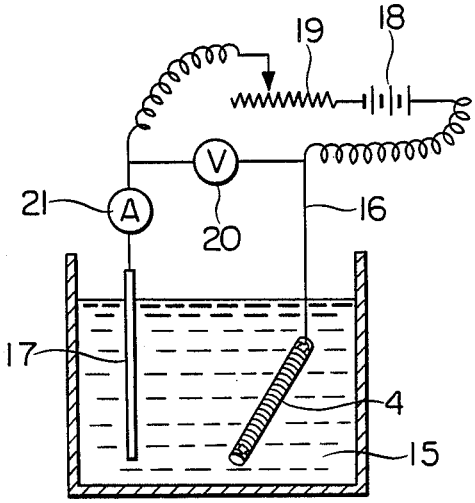
FIG. 4 is a diagram of assistance in explaining the electrolytic etching method.

Next, a resistance element 4 found generating sliding noise was selected and subjected to electrolytic etching treatment. FIG. 4 shows a device for electrolytically etching the resistance element 4. Electrolytic etching was carried out by using the resistance element 4 as the anode, suspended at an end thereof by a platinum wire 16 in an electrolyte solution 15 chiefly containing oxalic acid, as shown in Table 1, and applying a 6-v d-c voltage across the resistance element 4 as the anode and a stainless steel cathode 17 for ten seconds from a d-c power supply via a variable resistor 19. In the figure, reference numeral 20 denotes a voltmeter and 21 an ammeter. Upon completion of voltage application, the resistance element 4 was washed with running water for ten minutes while applying ultrasonic waves to the running water, dewatered with ethyl alcohol, and dried by hot air heated to 120° C.

TABLE 1

| Chemical composition | Concentration |
|---|---|
| Distilled water | 100 ml |
| Oxalic acid | 10 g |

Figure 3B:
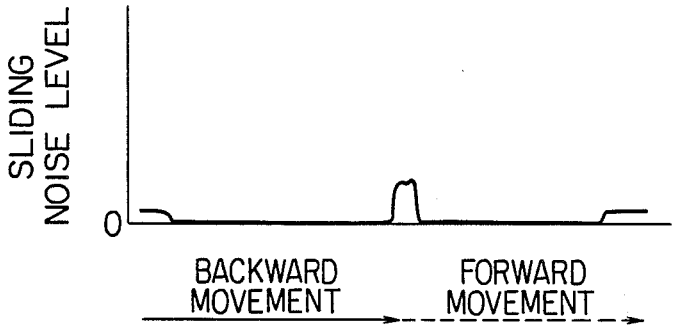
FIG. 3B is a diagram illustrating the sliding noise level of a resistance element which was subjected to electrolytic etching.

Next, the sliding noise of the electrolytically etched resistance element 4 was measured under the same conditions as in the aforementioned measurement of the sliding noise of the resistance element not subjected to electrolytic etching. The measurement results are shown in FIG. 3B. Although slight sliding noises were observed at the start, end and turning points of the reciprocal sliding movement due to the soldered ends of the resistance element 4, no noise was detected over the entire sliding range. This was due to the fact that not only the metallic oxides, chlorides and sulfides considered acting as insulators but also organic molecules, adsorbed gases and other contamination forming the surface layer of the resistance wire were dissolved and removed by electrolytic etching.

Embodiment 2

This embodiment involves electrolytic etching on a resistance element comprising a resistance wire containing Ni and Cu wound on a core.

As shown in FIG. 1A, a linear resistance material 3 was prepared by winding a 90-micron-dia. resistance wire 2 containing Ni and Cu (Trade name: CN wire, manufactured by Tokyo Senzai Kogyo Co.) on a core consisting of a 1.3-mm-dia. polyamide-imide-coated copper wire 1 at 140-micron pitches. A resistance element 4 was then prepared by cutting the resistance material 3 to a length equal to a terminal resistance of 50 ohms, as shown in FIG. 1B. After sliding noise was measured on the resistance element 4 prior to electrolytic etching in accordance with the procedure shown in Embodiment 1, the resistance element 4 was subjected to electrolytic etching in the manner shown in FIG. 4. The electrolyte 15, whose chemical composition is shown in Table 2, chiefly contains phosphoric acid. A nickel plate was used as the cathode 17, and 5-V d-c voltage was applied for seven seconds. Upon completion of voltage application, the resistance element 4 was immersed in a 10% caustic soda solution for neutralization, immersed in running water for ten minutes, dewatered with ethyl alcohol, and dried by hot air.

TABLE 2

| Chemical composition | Concentration |
|---|---|
| Distilled water | 30 ml |
| Phosphoric acid (specific gravity: 1.71) | 70 ml |
| Sulfuric acid (specific gravity: 1.84) | 5 ml |

Figure 5A:
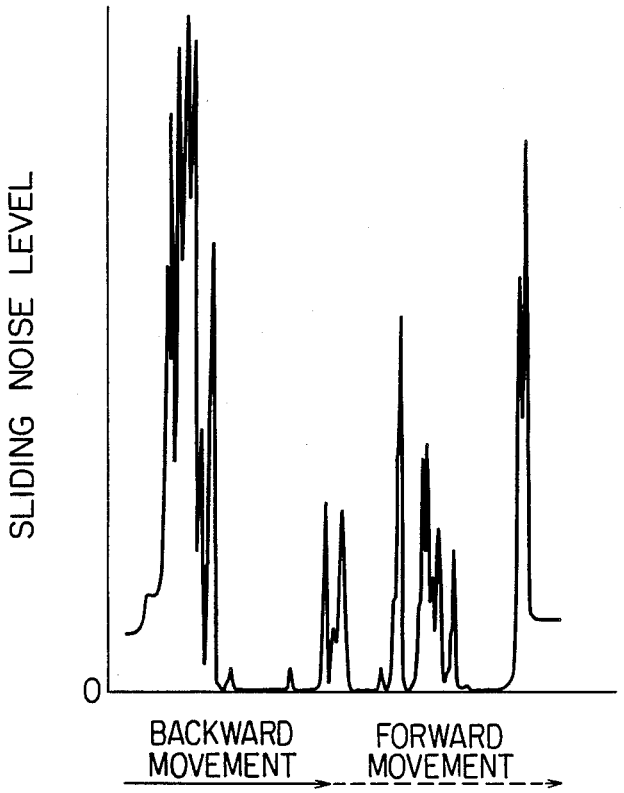
FIG. 5A is a diagram illustrating the sliding noise level of a resistance element which was not subjected to electrolytic etching.
Figure 5B:
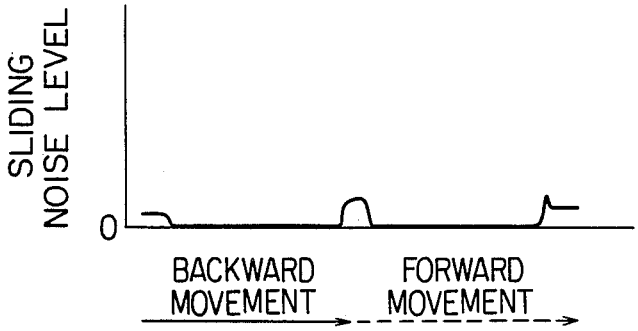
FIG. 5B is a diagram illustrating the sliding noise level of a resistance element which was subjected to electrolytic etching.

Even with the resistance element generating remarkable sliding noise prior to electrolytic etching, as shown in FIG. 5A, sliding noise was completely eliminated after electrolytic etching, as shown in FIG. 5B.

In this embodiment, description has been made as to the electrolytic etching conditions of an applied voltage of 5 V and a voltage application time of seven seconds. The voltage, however, may be changed in the range of 2 to 10 V, and the voltage application time in the range of 2 to 60 seconds. At a voltage lower than 2 V, etching may not be performed, while at a voltage higher than 10 V, local corrosion may proceed as gas evolves from the resistance element surface, resulting in a breakage of the resistance wire. If the voltage application time is shorter than 2 seconds, unetched areas may be left on the resistance wire surface. This may lead to failure to eliminate sliding noise. If voltage is applied for 60 seconds or more, it is difficult to set the resistance value of the resistance wire after etching.

In this embodiment where a Cu-Ni resistance wire is used, electrolytic etching in an electrolyte solution that has been put into service for a long period of time, that is, an aged electrolyte solution, would result in precipitation of copper after the surface layer of the resistance wire has been dissolved. With such a resistance wire, sliding noise is not detected immediately after etching treatment, but after exposure to high temperatures for a long period of time the precipitated copper may be oxidized, causing sliding noise. This problem can be solved by immersing the electrolytically etched resistance element in an ammonia solution to dissolve the precipitated copper on the surface, and cleaning and drying the element. Although there is no limitation in the immersion time of the resistance element in the ammonia solution, an immersion time of less than 20 minutes is sufficient for the purpose.

Figure 6A:
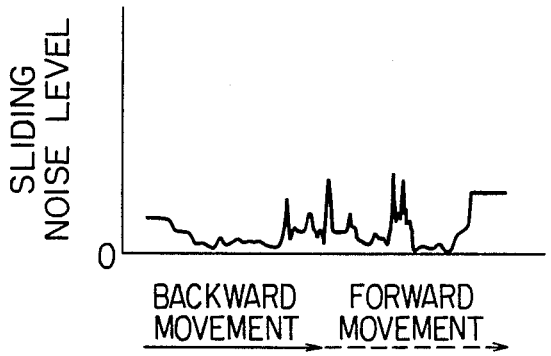
FIG. 6A is a diagram illustrating the sliding noise level of a resistance element which was not immersed in an ammonia solution.
Figure 6B:
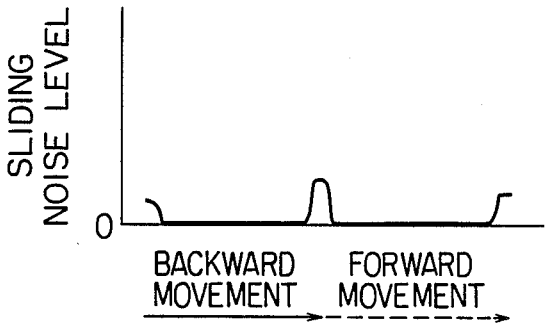
FIG. 6B is a diagram illustrating the sliding noise level of a resistance element which was immersed in an ammonia solution.

FIGS. 6A and 6B show the measurement results of sliding noise on two resistance elements which were subjected to etching treatment with an electrolyte solution that had been used for a long period of time, one with the subsequent ammonia solution immersion treatment and another without the immersion treatment, and held in a 120° C. atmosphere for 96 hours. With the resistance element without the ammonia solution immersion treatment, the precipitated copper was oxidized, generating sliding noise, as shown in FIG. 6A, while with the resistance element that was immersed in an ammonia solution after the etching treatment, no sliding noise was observed, as shown in FIG. 6B, because the precipitated copper was dissolved in the ammonia solution.

In the aforementioned two embodiments, the electrolytic etching solution used in Embodiment 1 was an oxalic acid solution having a predetermined concentration, and the electrolytic etching solution used in Embodiment 2 was a mixture of phosphoric acid and sulfuric acid of predetermined concentrations. However, there is no limitation in the chemical composition and concentration of electrolyte solution so long as the electrolyte solution ensures uniform etching of a resistance wire. Particularly effective in realizing this invention, however, is an electrolyte solution containing at least any one of sulfuric acid, ammonium persulfate, oxalic acid, nitric acid, copper nitrate and phosphoric acid that ensure uniform electrolytic etching independently of the diameter and electric resistance characteristics of a resistance wire to be wound on the core.

In addition, the solution to dissolve the copper precipitated on the surface of a resistance wire is not limited to an ammonia solution, but may be any type of solution, regardless of the chemical composition thereof, that can dissolve copper without adversely affecting a resistance wire.

Embodiment 3

This embodiment involves chemical etching on a resistance element comprising a resistance wire containing Ni and Cr.

Figure 1C:
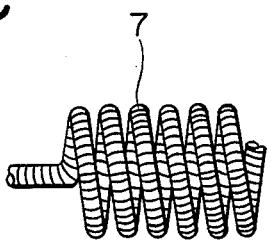
FIG. 1C is a perspective view of a helical coil obtained by helically winding the linear resistance material shown in FIG. 1A.
Figure 1D:
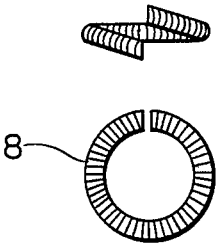
FIG. 1D is a diagram illustrating a one-turn coil cut from the helical coil shown in FIG. 1C.

As shown in FIG. 1A, a linear resistance material 3 was prepared by winding a commercially available 16.5-micron-dia. resistance wire 2 containing Ni and Cr (Trade mark: Molecuroi, manufactured by Molecu-Wire Corp.) on a core made of a 1.4-mm-dia. polyamide-imide-coated copper wire at 28-micron pitches. A helical coil 7 was obtained by coiling the linear resistance material 3, as shown in FIG. 1C, and a one-turn coil 8 was cut from the helical coil 7, as shown in FIG. 1D. The remaining helical coil 7 was immersed in a copper sulfate solution having a chemical composition shown in Table 3 for three seconds for chemical etching. Upon completion of chemical etching, the helical coil 7 was immersed in a caustic soda solution adjusted to a pH value of 11.5 for neutralization, washed with running water for five minutes, dewatered with ethyl alcohol, and dried with hot air. Furthermore, another one-turn coil 8 was cut from this chemically etched helical coil 7. Both the chemically etched one-turn coil and the abovementioned unetched one-turn coil were, after being formed into horseshoe-type resistance elements 9, incorporated into separate wound-type 20-kohm variable resistors.

Figure 7A:
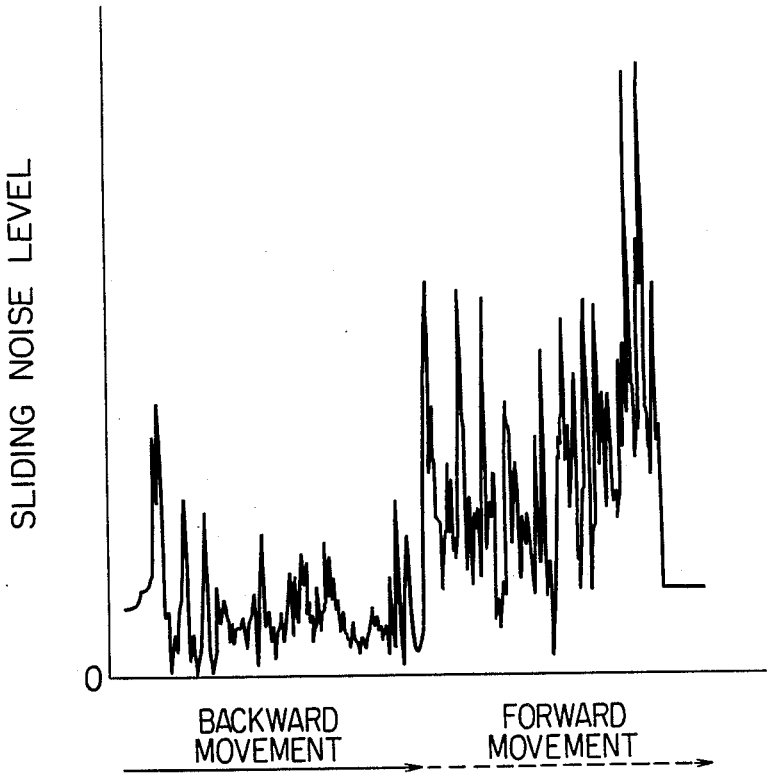
FIG. 7A is a diagram illustrating the sliding noise level of a wound-type variable resistor having a resistance element which was not subjected to chemical etching.
Figure 7B:
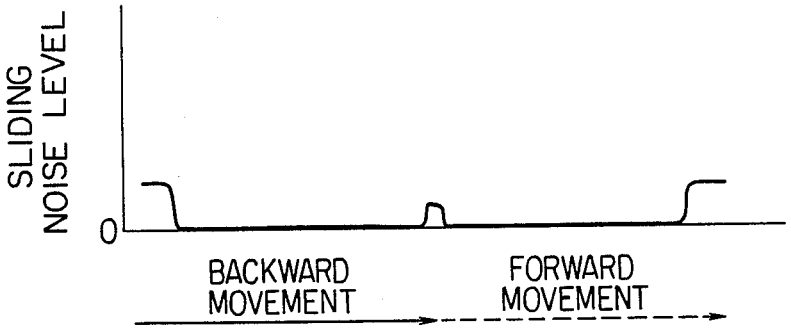
FIG. 7B is a diagram illustrating the sliding noise level of a wound-type variable resistor having a resistance element which was subjected to chemical etching.

The sliding noise of separate variable resistors having resistance elements with and without chemical etching treatment was measured. The measurement was carried out with the same constant-current method as dsecribed with reference to FIG. 2 by observing the sliding noise on an oscilloscope while causing the slider to reciprocally slide over the resistance element. The measurement results are shown in FIGS. 7A and 7B. Whereas the wound-type variable resistor having the resistance element without chemical etching generated sliding noise from the beginning of the test, as shown in FIG. 7A, the wound-type variable resistor having the chemically etched resistance element did not generate any sliding noise, as shown in FIG. 7B.

TABLE 3

| Chemical composition | Concentration |
|---|---|
| Distilled water | 50 ml |
| Ethyl alcohol (96%) | 50 ml |
| Hydrochloric acid (specific gravity: 1.15) | 50 ml |
| Copper sulfate | 10 g |

In this embodiment, a solution containing copper sulfate as shown in Table 3 was used for chemical etching. Since the purpose of chemical etching treatment in this invention, however, is to dissolve the surface layer of the resistance wire with etching treatment, there is no limitation in the chemical composition and concentration of etching solution so long as the solution meets the purpose. That is, any chemical composition and concentration of an etching solution may be selected, depending on the complexity of the etching of the resistance wire. Particularly suitable for uniformly and rapidly etching an extra-fine resistance wire wound on a core is a solution containing at least any one of copper sulfate, copper chloride, copper nitrate and iron chloride.

Embodiment 4

This embodiment is concerned with a resistance element comprising a resistance wire containing Ni and Cu wound on a core, which was subjected to chemical etching treatment and then immersed in an ammonia solution.

When a chemical etching solution containing copper is used, copper may be precipitated on the surface of a chemically etched resistance wire. With a resistance element using such a resistance wire, sliding noise is not detected immediately after chemical etching. When the etched resistance element is held at high temperatures for a long period of time, however, the precipitated copper may be oxidized, generating sliding noise. In such a case, it is necessary to dissolve the copper precipitated on the surface by immersing the etched resistance element in an ammonia solution, as in the case of Embodiment 2. In this embodiment involving a Cu-Ni resistance wire, copper may also be precipitated on the surface of the resistance wire when chemical etching is performed with an aged chemical etching solution. In such a case, too, immersion of the resistance wire in an ammonia solution has an effect of dissolving the precipitated copper.

Figure 1E:
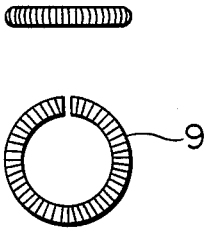
FIG. 1E is a diagram illustrating a horseshoe-type resistance element obtained by forming the one-turn coil shown in FIG. 1D.

In this embodiment, a linear resistance material was prepared by winding a commercially available 120-micron-dia. resistance wire containing Ni and Cu (Trade name: ADVANCE, manufactured by Driver-Harris Co.) on a 1.2-mm-dia. polyester-coated copper wire at 180-micron pitches (see FIG. 1A). Then, a horseshoe-type resistance element having a total resistance value of 20 ohms was prepared in accordance with the manufacturing procedure described with reference to Embodiment 3 (see FIG. 1E). The resistance element was chemically etched by immersing in a solution having a chemical composition shown in Table 4 for five seconds. After being washed and dried in accordance with the procedure described with reference to Embodiment 3, the chemically etched resistance element was immersed in an ammonia solution for five minutes, washed again with running water, and dried with hot air.

TABLE 4

| Chemical composition | Concentration |
|---|---|
| Distilled water | 40 ml |
| Copper chloride | 36 g |
| Hydrochloric acid | 48 ml |
| Inhibitor | 2% |
| Surface activant | 0.01% |

Figure 8A:
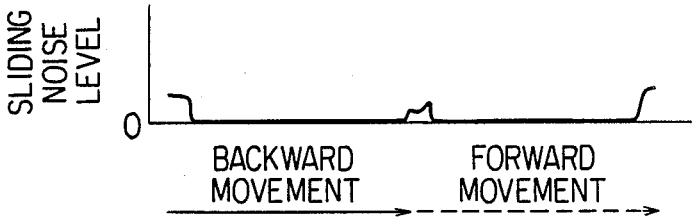
FIG. 8A is a diagram illustrating the sliding noise level of a wound-type variable resistor immediately after the resistance element subjected to ammonia solution dipping was incorporated therein.
Figure 8B:
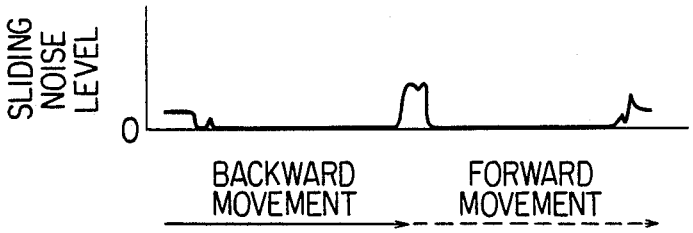
FIG. 8B is a diagram illustrating the sliding noise level of a wound-type variable resistor having the resistance element subjected to ammonia solution dipping, which was held at a predetermined temperature for a predetermined period of time.

The measurement results of sliding noise on a wound-type variable resistor immediately after the resistance element thus produced was incorporated therein are shown in FIG. 8A. No sliding noise was observed. Next, the measurement results of sliding noise on the variable resistor after being held at 120° C. for 240 hours are shown in FIG. 8B. As can be seen in the figure, there was no change in the level of sliding noise and no deterioration was observed in the resistance element even after the variable resistor was held at high temperatures for a long period of time.

Figure 8C:
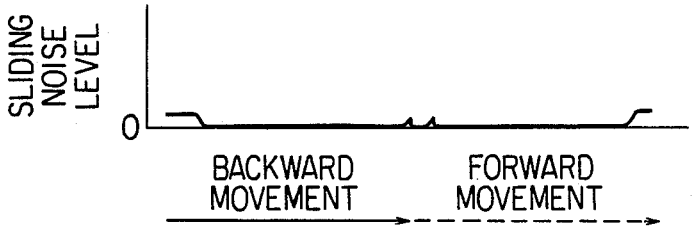
FIG. 8C is a diagram illustrating the sliding noise level of a variable resistor immediately after the resistance element, which was subjected to chemical etching but not immersed in an ammonia solution, was incorporated therein.

FIG. 8C shows the measurement results of sliding noise on a variable resistor incorporating a resistance element which was subjected to chemical etching only and not immersed in an ammonia solution. As in the case of FIGS. 8A and 8B, no sliding noise was detected.

Figure 8D:
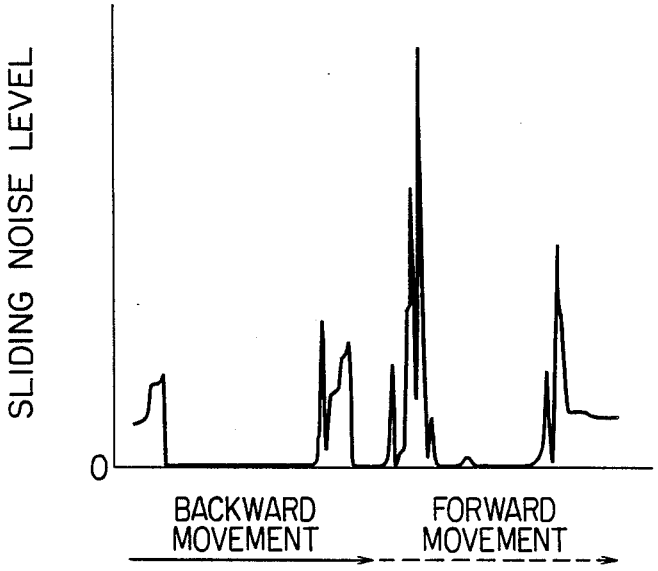
FIG. 8D is a diagram illustrating the sliding noise level of a variable resistor having a resistance element subjected to chemical etching but not immersed in an ammonia solution, which was held at a predetermined temperature for a predetermined period of time.

FIG. 8D shows the measurement results of sliding noise on a variable resistor incorporating a resistance element subjected to chemical etching treatment only and not immersed in an ammonia solution, which was held at 120° C. for 240 hours. In this case, sliding noise was generated because the copper on the surface of the resistance wire was oxidized, acting as an insulator.

In this embodiment, too, the solution for dissolving the precipitated copper on the surface of the resistance wire is not limited to an ammonia solution. There is no limitation in the chemical composition of the solution so long as the solution can dissolve copper without adversely affecting the resistance wire, as in the case of Embodiment 2.

In the foregoing, four embodiments of this invention have been described. Since the electrolyte solution or chemical etching solution used in this invention exhibit strong acidity, the residual solution on the surface of the etched resistance element may cause corrosion, leading to a breakage of the resistance wire. Immersion of the resistance element in an alkaline solution, such as caustic alkali, sodium carbonate, sodium bicarbonate, calcium carbonate, slaked lime, etc., prior to washing with running water for neutralization has an effect of preventing such corrosion.

Since the surface of a resistance wire is dissolved during etching treatment, the diameter of the resistance wire is reduced, resulting in an increase in resistance value. Overetching therefore tends to cause wire breakage during handling after etching. Particularly in electrolytic etching, the portion of a resistance wire at which the resistance wire is suspended on the electrode is dissolved more than the other portions away from the suspended portion. This causes fluctuations in resistance value with the location of the resistance wire.

By limiting this increase in the post-treatment resistance value to less than 10% of the pretreatment resistance value, fluctuations in resistance value with the location of the wire can be reduced to a negligible level without causing the breakage of the wire.

What is claimed is:

1. A method of making a resistance element for wound-type variable resistors having a metallic resistance wire and a core, the method comprising the steps of: preparing a resistance material by winding a metallic resistance wire, formed of either nickel and chromium or nickel and copper on the core; subjecting said resistance wire to electrolyte etching treatment employing an electrolyte solution containing at least any one type of sulfuric acid, ammonium persulfate, oxalic acid, nitric acid, copper nitrate and phosphoric acid; and, after subjecting said resistance wire to electrolyte etching treatment, immersing said resistance wire in a solution that dissolves copper.

2. A method of making a resistance element for wound-type variable resistors having a resistance material, in the form of a metallic resistance wire and a core, the method comprising the steps of: forming said core of a material including a copper wire with a plastic coating; forming said resistance wire of either nickel and chromium or nickel and copper; subjecting said resistance wire to chemical etching treatment, said treatment employing a solution including at least any one type of copper chloride, copper sulfate, copper nitrate and iron chloride; and, after subjecting said resistance wire to chemical etching treatment, immersing said resistance wire in a solution that dissolves copper.

3. A method of making a resistance element for wound-type variable resistors according to either claim 1 or 2 wherein: said etching treatment is limited to a degree at which an increase in its post-treatment resistance value of said resistance wire does not exceed 10% of the pretreatment value thereof.

* * * * *